US006118105A

United States Patent [19]

Berkcan et al.

[11] Patent Number: 6,118,105

[45] Date of Patent: Sep. 12, 2000

[54] MONITORING AND CONTROL SYSTEM FOR MONITORING THE BOIL STATE OF CONTENTS OF A COOKING UTENSIL

[75] Inventors: Ertugrul Berkcan, Niskayuna; Emilie Thorbjorg Saulnier, Rexford; Paul Randall Wilson, Scotia; Vivek Venugopal Badami, Schenectady, all of N.Y.

[73] Assignee: General Electric Company, Schenectady, N.Y.

[21] Appl. No.: 09/356,965

[22] Filed: Jul. 19, 1999

[51] Int. Cl.[7] ..... H05B 1/02

[52] U.S. Cl. ..... 219/497; 219/481; 219/502; 219/553; 219/449; 99/325; 340/589; 374/107

[58] Field of Search ..... 219/497, 502, 219/506, 481, 448–452, 494, 505; 99/325–331; 340/582, 588, 589; 374/102, 107

[56] References Cited

U.S. PATENT DOCUMENTS

| | | | |
|---|---|---|---|
| 4,237,368 | 12/1980 | Welch . | |
| 4,740,664 | 4/1988 | Payne et al. | 219/449 |
| 5,079,407 | 1/1992 | Baker | 219/448 |
| 5,138,135 | 8/1992 | Husslein et al. . | |
| 5,430,427 | 7/1995 | Newman et al. . | |

FOREIGN PATENT DOCUMENTS 0806887 11/1997 European Pat. Off. .

OTHER PUBLICATIONS

"Method And Apparatus For Boil State Detection Based on Acoustic Signal Features," E. Berkcan et al., Serial No. 09/273,065 (GE docket RD–26098), filed Mar. 19, 1999.

"Acoustic Sensing System For Boil State Detection And Method For Determining Boil State," E. Berkcan et al., Serial No. 09/273,064 (GE docket RD–26042), filed Mar. 19, 1999.

"Method And Apparatus For Boil Phase Detection," P. Bonanni et al., Serial No. 09/211,161 (GE docket RD–26420) filed Dec. 14, 1998.

*Primary Examiner*—Mark Paschall

*Attorney, Agent, or Firm*—Jill M. Breedlove; Douglas E. Stoner

[57] ABSTRACT

A monitoring and control system for monitoring the boil states of the contents of a cooking utensil located on a cooking surface of a cooktop, indicating the state to a user, and controlling the energy applied to the cooking surface, which may be a glass ceramic. The system includes at least one controllable heat source located below the lower surface of the cooktop so as to heat the cooktop and cooking utensil, at least one sensor located in proximity to the cooktop, which senses the temperature of at least one of the cooktop and the cooking utensil, at least one power indicative signal, and a signal processing device receiving a temperature signal from the sensor, and the power indicative signal. The signal issued by the sensor is representative of the temperature of either the cooktop, or the cooking utensil. In one embodiment the signal processing device detects a plateau in the sensor and power indicative signals, which is indicative of the boiling of the contents of the cooking utensil, or an increase in the rise of the sensor signal, which is indicative of a boil-dry condition in the cooking utensil. The signal processing device optionally is connected to a control device which automatically reduces the temperature of the heat source upon the occurrence of these conditions, or which provides an indication to the user that such conditions have occurred. Determining the boil states, such as boiling, boil-over and boil-dry for the contents of a cooking utensil on a glass ceramic cooktop is achieved by noting that a characteristic response exists in the signal generated by a temperature indicative sensor or the power indicative signal as the temperature of the contents of a cooking utensil on a glass ceramic cooktop approaches a boiling point.

32 Claims, 10 Drawing Sheets

70

MONITORING AND CONTROL SYSTEM FOR MONITORING THE BOIL STATE OF CONTENTS OF A COOKING UTENSIL

CROSS REFERENCE TO RELATED APPLICATIONS

This application is related to Ser. No. 09/356,964, entitled, "MONITORING AND CONTROL SYSTEM FOR MONITORING THE TEMPERATURE OF A GLASS CERAMIC COOKTOP," filed on Jul. 1999, assigned to the assignee of the present application, and herein incorporated by reference.

BACKGROUND OF THE INVENTION

The present invention relates to a monitoring and a control system for monitoring the boil states of the contents of a cooking utensil located on a cooking surface of a cooktop and then responding by at least one of providing indication of the state to a user, issuing a signal representative of the state, and controlling the energy applied to the cooking surface.

Recently, standard porcelain enamel cooktop surfaces of domestic ranges have been replaced by smooth surface, high resistivity cooktops located above one or more heat sources, such as electrical heating elements or gas burners. The smooth surface cooktops improve cleanability of the cooktops, because they provide a continuous surface without seams or recesses in which debris can accumulate. The continuous cooktop surface also prevents spillovers from coming into contact with the heating elements, or burners. Such cooktops may be milk-white, opaque, glass ceramic or crystal and glass material sold under various tradenames. Glass ceramic material is used frequently because of its low coefficient of thermal expansion and smooth top surface that presents a pleasing appearance.

Glass ceramic surface cooktops are less thermally efficient than are standard cooktops utilizing metal sheathed electrical resistance heating elements having a spiral configuration. The high thermal mass of the glass ceramic material has a slow thermal response, thereby requiring a longer time to heat up or cool down. The heat is stored in the glass ceramic cooktop as well as in the sheathed heating element and the insulating support block or pad, which typically accompany the heating element. When open coil heaters are used at a spaced distance bellow the cooktop, there is also poor thermal coupling between the heat source and the glass ceramic plate. In order to transfer a requisite amount of heat from an open coil heater to the cooktop, the heat source has to operate at a higher temperature than otherwise, which creates problems, such as poor system efficiency, high heat losses, component overheating and high cooktop temperatures. Glass ceramic cooktops in surface units with open coil heaters also may present a safety hazard in the event the cooktop is broken.

Boiling water or other fluids or foods (generically "liquids") is a common step in cooking. For instance, boiling liquids is one of the most common uses for a range. It is typically desirable to closely monitor the boil phase of the liquid during such processes, i.e., to identify boil phases and boil-dry conditions. In this regard, the pre-simmer phase is generally characterized by a calm liquid and the simmer onset phase is an initial, slow bubbling of the liquid characterized by the appearance of individual bubbles. During the simmer phase, bubbles appear in jets creating the effect commonly referred to as simmering. Finally, in the boil phase, the bubbling of the liquid is generalized, resulting in the familiar turbulence of a boiling liquid. These phases can be identified by experts and experienced cooks.

The boiling state is also characterized by the liquid remaining at a constant maximum "boiling" temperature as increased levels of energy are applied due to the phase transition properties of water. The liquid acts as a heat barrier which leads to changes in the thermal transfer properties of the cooktop and the utensil as the liquid approaches and then reaches the boiling temperature. These thermal properties lead to characteristic features in the thermal or power indicative signals as various boil states are attained.

The boil phase of a liquid is monitored for a number of reasons. First, many cooking processes require that the liquid be attended to upon identification of a particular boil phase, e.g., reducing the heat after the liquid reaches a boil. The boil phase may be monitored to reduce heat after the liquid reaches a boil, either to reduce it to a simmer for cooking purposes or to prevent boil-over. Boil-over can result in a burned-on residue on the cooktop, or, in the case of gas ranges, extermination of the cooking flame.

Another reason for monitoring the boil phase is to prevent a boil-dry condition, which may result in burning of the food, damaging the cooking utensil and potential fire hazards. A still further reason is to provide automation to supplant visual monitoring of the boil phase by the user. Such visual monitoring can interfere with the user's ability to prepare other foods or be otherwise disposed during the heating of the liquid. Moreover, a busy or inexperienced cook may fail to accurately, or in a timely manner, identify a boil phase of interest.

Increasingly, manufacturers seek to provide, and consumers desire to have appliances with a greater degree of automated operation and control. With the increasing affordability of integrating computing power into an appliance, there exists a potential to provide the increased levels of automated control. However, information gathering tools or devices that interact with a computer or microcontroller in monitoring or controlling the operation of the appliance must also have desirable cost and performance attributes.

For cooking appliances generally, and for electric and gas range cooktops specifically, automation or partial automation of control of the cooking process, or monitoring of cooking on a cooktop, has traditionally focused on temperature monitoring or sensing. Various temperature sensors have been proposed for sensing the temperature of a surface heating unit or a cooking utensil positioned thereon or food contents located therein, and for controlling the heat input to the heating unit, based on the sensed temperature. Such sensors have commonly been proposed for use in connection with glass ceramic radiant cooktops, and purport to enable detection and control of cooking states of food within a cooking utensil. The sensors directly monitor temperature of the liquid contents of the utensil, and are frequently coupled to the heating unit control system to provide feedback to the control system.

Food temperature-based sensing systems for range cooktops may indirectly or inferentially provide information regarding a boil state of a liquid contained in a utensil and being heated on the cooktop. However, a method for reliably determining the boil state continues to be a problem in cooktop sensing and control, because the correlation between food temperature and boil state depends on a number of variables including, but not limited to, type of liquid, any additives such as salt which raises the boiling point, and the elevation above sea level which raises the boiling point. Finally, the position of the temperature sensor and its calibration can also have a significant impact on achievable accuracy. The general need then is to develop an approach to boil state determination that is more robust to cooking modalities, vessels used, various user interactions, and other variations, or disturbances, in the equipment or environment.

BRIEF SUMMARY OF THE INVENTION

The present invention relates to a monitoring and control system for monitoring the boil states of the contents of a cooking utensil located on a cooking surface of a cooktop, which preferably is a glass ceramic, and then responding by at least one of providing indication of the state to a user, issuing a signal representative of the state, and controlling the energy applied to the cooking surface. The monitoring and control system also includes a signal processing device and a signal indicative of the power level to the monitored energy source, and alternatively control and indication apparatus to indicate the monitored state to a user and to control the energy source. In addition, the invention includes amplification and filtering by interface electronics, as well as multiplexing electronics circuitry connected between the sensors of different radiating energy sources. Radiating energy sources include all sources resulting in the generation of heat in the contents of a cooking utensil, including induction heating sources.

In one exemplary embodiment according to this invention the system utilizes a temperature sensor including thermocouples, RTD's (resistance temperature detectors), traces under the cooktop which may be, for example, glass ceramic, or other suitable temperature sensor indicative of the temperature of the area of the glass ceramic cooktop under the utensil being heated by the energy source.

In another exemplary embodiment according to this invention, the system utilizes an optical sensor assembly comprising one or more optical detectors as part of its assembly and any corresponding filters to limit the range of infrared radiation sensed by the optical detectors. Known filters are used to limit the spectrum of the observed radiation such that the level of the observed signal best represents the temperature of interest. In particular, a filter is used to focus on the wavelengths to which the glass ceramic cooktop is opaque. Alternatively, the filter is further utilized to minimize interference caused by reflection and other radiation components, such as that generated by ambient lighting and non-cooktop reflection.

The monitoring and control system includes at least one controllable radiating energy source located below the lower surface of the cooktop so as to heat the cooking utensil on a cooktop surface, at least one sensor located below the lower surface of the cooktop, which senses radiation from the cooktop or the cooking utensil and a signal processing device receiving a temperature signal from the sensor(s), and at least one signal indicative of the power level supplied to the energy source. The signal issued by the sensor is representative of the temperature of either the cooktop or the cooking utensil, and the signal processing device will detect a pattern or signature in the signal, such as, for example, a plateau, which is indicative of the boil state of the contents of the cooking utensil, or a sharp increase in the rise of the signal, which is indicative of a boil-dry condition in the cooking utensil. The signal processing device may be connected to a control device which automatically reduces the temperature of the heat source or provides an indication to the user upon the occurrence of these conditions.

The pattern or signature in the signal is detected by noting a characteristic response that exists in the signal generated by the sensor as the temperature of the contents of a cooking utensil on a glass ceramic cooktop approaches a boiling point. This response manifests itself in the form of algorithmically recognizable aspects in the signal that include a plateau, or a flattening of the signal. These aspects are detected via an approach based on an algorithmic analysis that includes the calculation of derivatives or other characteristics of the signal generated by the sensor. In addition to the above plateau, other heuristic, or empirical values may also be defined. For example, there are intermediate points that indicate the onset of simmer where the derivatives or the magnitude of the signal take on particular values. Such intermediate points are defined through experimentation based on correlation with food temperature or other factors, such as cooking utensil type and food amount.

Other features of the signal read from the sensor are defined for use in detecting other boil states, such as boil-dry, a state when all of the liquid in the cooking utensil has been boiled off, and boil-over, a state when the contents of the cooking utensil are spilling over the brim of the utensil onto the cooktop. When the boil-dry state occurs, for example, a sharp rise in the signal from the sensor is detected and may be utilized to indicate the onset of the boil-dry condition. It should also be noted that other features of the signal read from the sensor, such as the change in the derivative as the boil process progresses, can also be used to detect various boil-related points or phases of water-based cooking. Other features of the monitoring system include features relating to monitoring the same states via the power indicative signal for boil states reached after a constant temperature control is instituted by the control.

The present system is based on detecting the temperature of the cooktop relatively or absolutely. In the case of using an optical sensor, this is achieved by sensing the radiation emission in an appropriate wavelength range, for example, 5–7$\mu$, from the cooktop that is in contact with the cooking utensil that contains the water-based food. This may also be achieved by detecting the optical flux in the heating chamber located between the heat source and the lower surface of the cooktop. An additional approach is based upon sensing the radiation in a wavelength range that the cooktop is transparent to, thereby effectively "looking" through the cooktop to detect the temperature of the cooking utensil itself. Through all of the approaches, the features in the signal and their changes are utilized to detect the onset of the boil phase as well as the boil-dry, or boil-over characteristics.

Indication of effective cooktop or cooking utensil temperature is achieved by a sensor which senses the temperature or radiation from at least a portion of the underside of the cooktop on which the cooking utensil is located, the sensor being located at the edge, side, bottom, or the top of the heat source. In the case of an optical sensor, a waveguide or other form of non-imaging optics may be utilized in order to locate the part of the sensor that houses the detector at the edge or side of the heat source, the waveguide or the other form of non-imaging optics serving to direct the radiation from the desired location onto the detector. The waveguide may comprise a hollow tubular element having an inlet located within the heating chamber and facing generally toward the cooktop and an exit end which directs the radiation onto an optical detector in the optical sensor.

For manufacturing considerations, it is undesirable to have the inlet end of the waveguide bearing directly against the surface of the cooktop. Thus, the necessary gap formed between the inlet end and the surface makes it necessary to use filters to filter out undesired radiation and reflected radiation in order to provide an accurate temperature measurement. The undesired reflective components may also be compensated for by algorithmic approaches. Alternatively, where no gap is present, filters are used to increase the sensitivity of the detector to a preferred wavelength range.

DETAILED DESCRIPTION OF THE INVENTION

Figure 1:
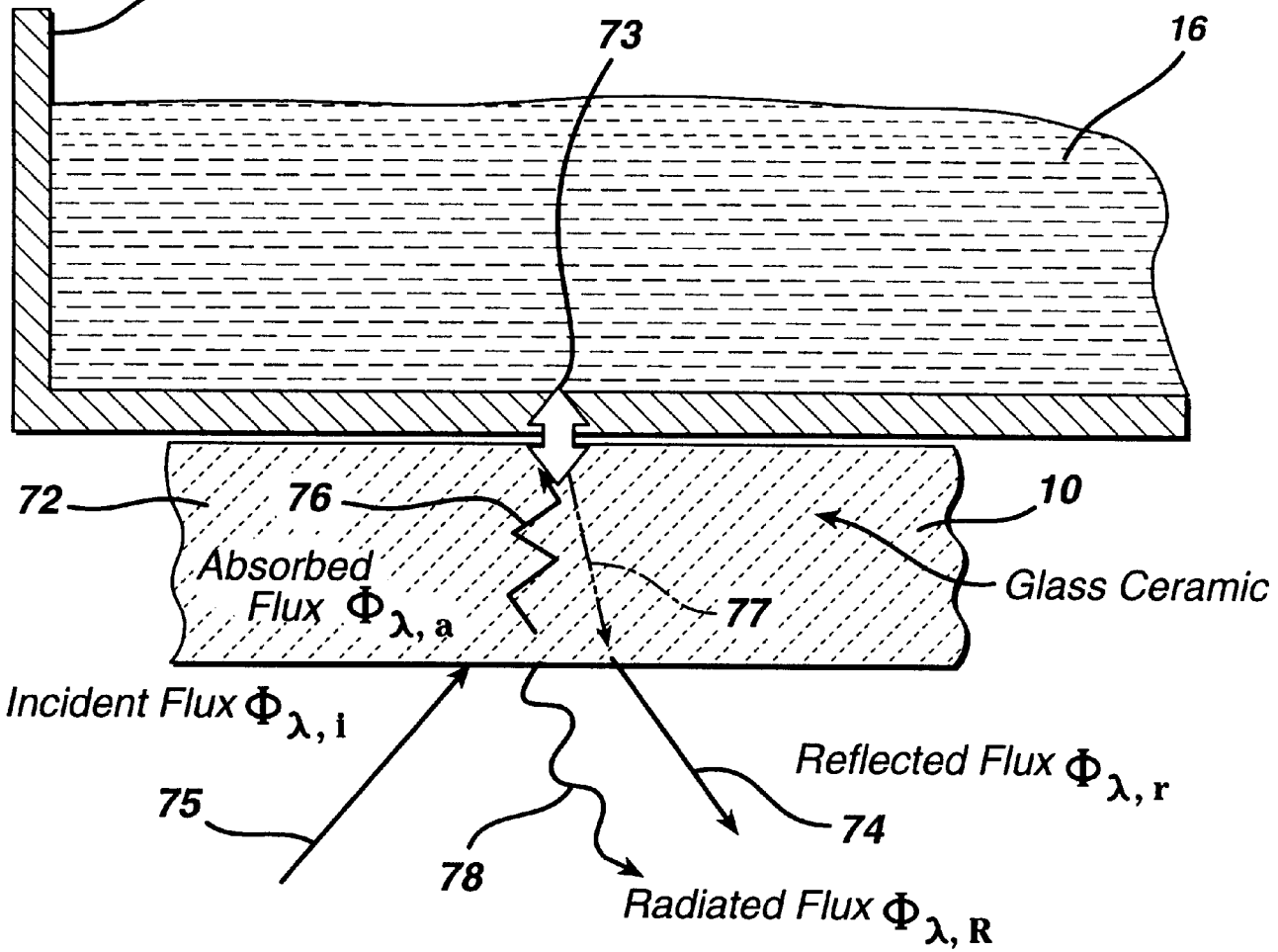
FIG. 1 is a partial, cross-sectional view of the glass ceramic cooktop, the utensil on the cooktop, and the various components of the optical flux according to the present invention.

FIG. 1 is a partial, cross-sectional view of a glass ceramic cooktop 10, the utensil 14 on the cooktop, and various components of optical flux. Optical flux is defined as the radiant power traversing a particular surface, and is typically measured in units of Watts. The glass ceramic cooktop 10 is used to support utensil 14 containing water-based contents 16. Various components of the flux include incident flux 75, reflected flux 74, as well as absorbed flux 72, and transmitted flux 76. This transmitted flux 76 gives rise to a further reflected and radiated component 77. This component 77 of the flux is caused in part due to the reflection from the utensil 14 and in part by heat transfer 73 between the cooktop 10 and utensil 14. This heat transfer 73 includes radiative as well as conductive parts, and contributes to the glass ceramic cooktop being indirectly indicative of the boiling states of the contents 16 of the utensil 14.

Figure 2:
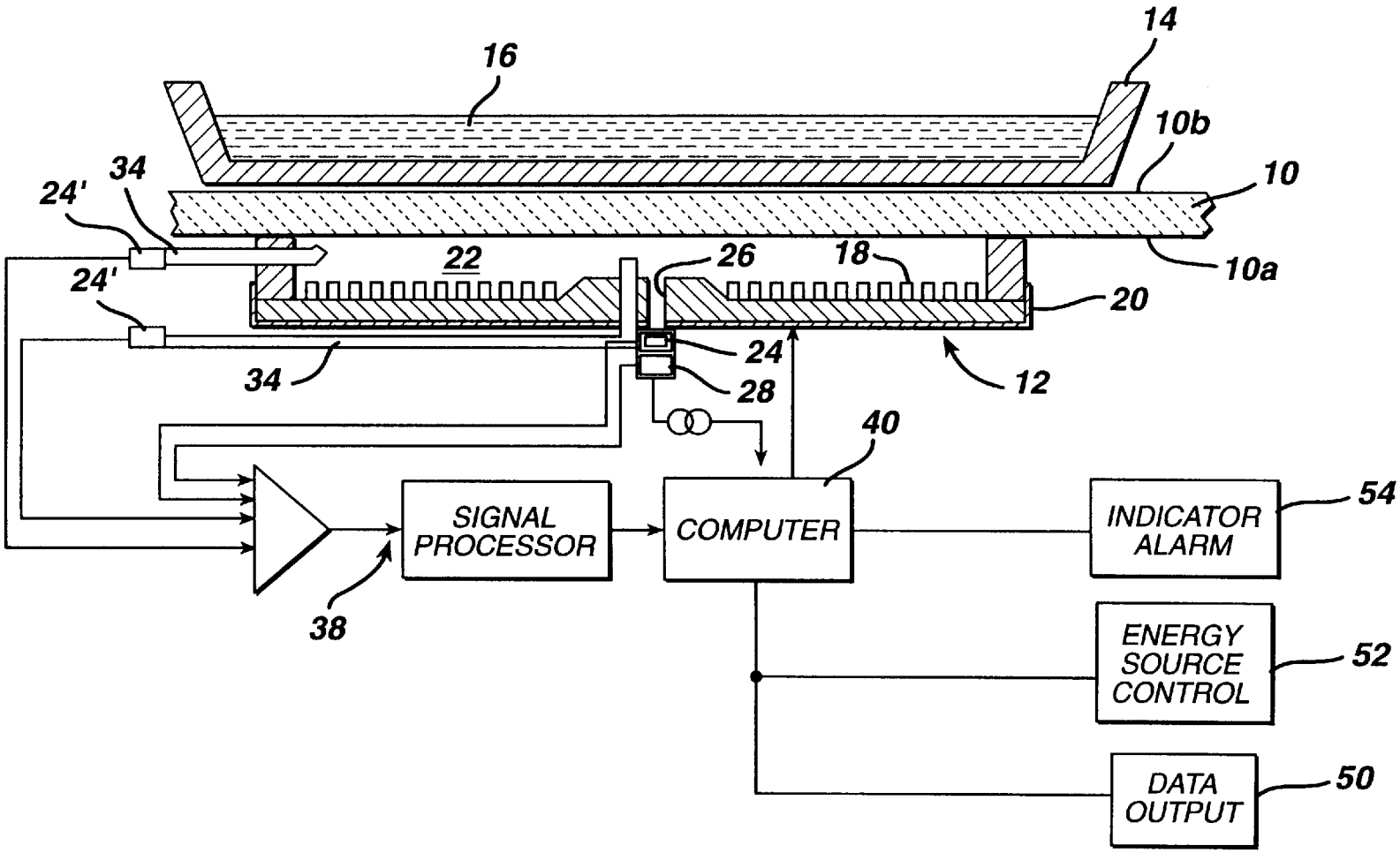
FIG. 2 is a schematic cross-sectional view of a glass ceramic cooktop incorporating various embodiments of the system according to the present invention.

As best seen in FIG. 2, the glass ceramic cooktop 10 has at least one controllable energy source 12 located relative to the cooktop so as to heat the cooktop and the cooking utensil. Preferably, the energy sensor 24 is located beneath the lower surface 10*a* of cooktop 10. At least one signal indicative of electrical power is supplied to the controllable energy source. The power indicative signal includes one of power level, power-on and power-off cycle times, or a function of power-on and power-off cycle times. An upper cooking surface 10*b* is the surface on which a cooking utensil 14 is placed to heat the contents 16. The energy source 12 typically comprises a heating coil 18 located within a burner casing 20 and forms a heating chamber 22 between the heating coil 18 and the lower surface 10*a* of the cooktop 10. In known fashion, the heating coil 18 is utilized to provide heat to the heating chamber 22, which in turn, heats the cooktop 10, the utensil 14, and the contents 16. Heating coil 18 is envisioned to include other heat source embodiments, for example, an induction heating element.

At least one sensor 24 is arranged to sense a parameter related to at least one of the cooktop and the cooking utensil and issue a signal responsive to the sensed parameter. The sensed parameter includes the temperature of the glass ceramic cooktop. A signal processing device connected to the at least one parameter sensor for receiving the issued sensor signal and arranged to receive the at least one power indicative signal, is arranged to process the received sensor signal and the power indicative signal to detect a known signal pattern indicating a boil state of the contents of the cooking utensil. In the case of using an optical sensor as the sensor 24, generally a waveguide, or other form of non-imaging optics, is utilized. The waveguide or non-imaging optics enables the optical detector to be positioned at a location independent of the desired sensing location within the chamber, between the heat source and the cooktop. This enables the optical detector to be located in a more favorable thermal environment, or to optimize other design considerations, such as the location of other optical detectors, or the sharing of the optical detectors among several heat sources. The waveguide parameters include the field of view into the heating chamber, the diameter of the waveguide and the material from which it is fabricated. A concentrator may be utilized to increase signal strength at the input end, and/or the exit end of the waveguide.

In one embodiment, an optical detector 24 is located directly below the burner casing 20 and "views" the ceramic cooktop 10 through an opening 26 in the burner casing 20. In an alternative embodiment, a short waveguide or other transparent medium (not shown) positioned in opening 26 is used to protect the detector 24 or to guide or focus the radiation. The infrared radiation from the glass ceramic cooktop 10 passes through the opening 26 and impinges on the optical detector 24.

In still another embodiment, the waveguide is a solid waveguide fabricated from a solid material that is optically conducting to the radiation in the selected wavelength range.

The detector 24, due to its location and construction, may be required to be temperature compensated to provide meaningful signals without undue influence from the heat generated by the coil 18. The temperature compensation is accomplished by using a signal indicative of the ambient temperature around the detector 24 or by a temperature sensor such as a thermistor 28, which measures the temperature of the optical detector 24, and which is connected to software programs in the processor 40, using two separate channels of an A/D converter, illustrated generally as signal processing circuitry 38. These software programs, described below in connection with FIG. 6, calculate a correction based on the output of the temperature sensor 28 and the filter used on the optical detector. The signal processing circuitry 38 is known signal processing circuitry that includes low pass filtering and amplification by a gain factor G. such as amplifier device 224 shown in FIG. 3.

Figure 3:
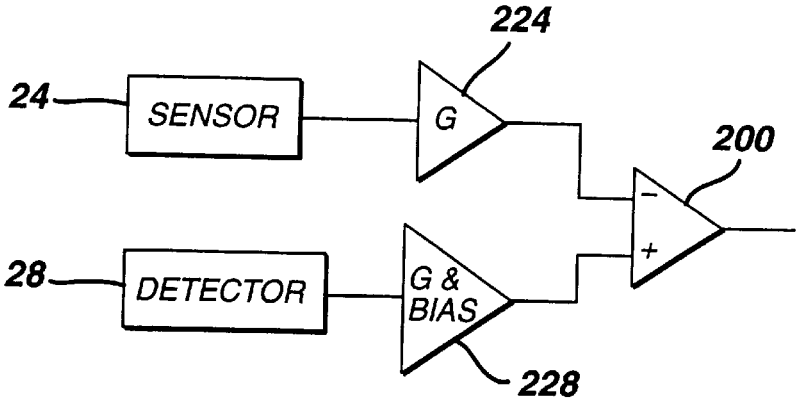
FIG. 3 is a schematic diagram of a circuit for temperature compensating the sensor utilized in the system according to the present invention.

FIG. 3 illustrates one example of hardware for accomplishing temperature compensation. In this case, the output of the optical detector 24 is amplified by a gain stage 224. Similarly, the output of the temperature sensor 28 is connected to a bias circuit, depending on the type of temperature detector, and the outputted signal is amplified by the circuit 228. The outputs of these two circuits are connected to the circuit 200, which is, for example, an operational amplifier arranged so that the temperature signal from the temperature sensor 28 is used to offset the signal outputted by the circuit 200.

Returning to FIG. 2, alternative detectors 24' illustrate example remote locations wherein the optical detector 24 is positioned remotely from the heat to provide optimal operating conditions. The establishment of any particular location for the detectors 24' depends on the specific arrangement of optical detector 24, heating coil 18 and burner casing 20. In the alternative positions for detectors 24', a waveguide 34 may be utilized in order for the detector 24' to receive radiation from within the heat chamber 22. The waveguide 34 alternatively comprises a hollow, tubular element having an inner surface which provides good infrared radiation reflectivity. Optionally, the inner surface of the waveguide 34 is coated with a layer of gold to achieve efficient reflectivity.

Figure 4:
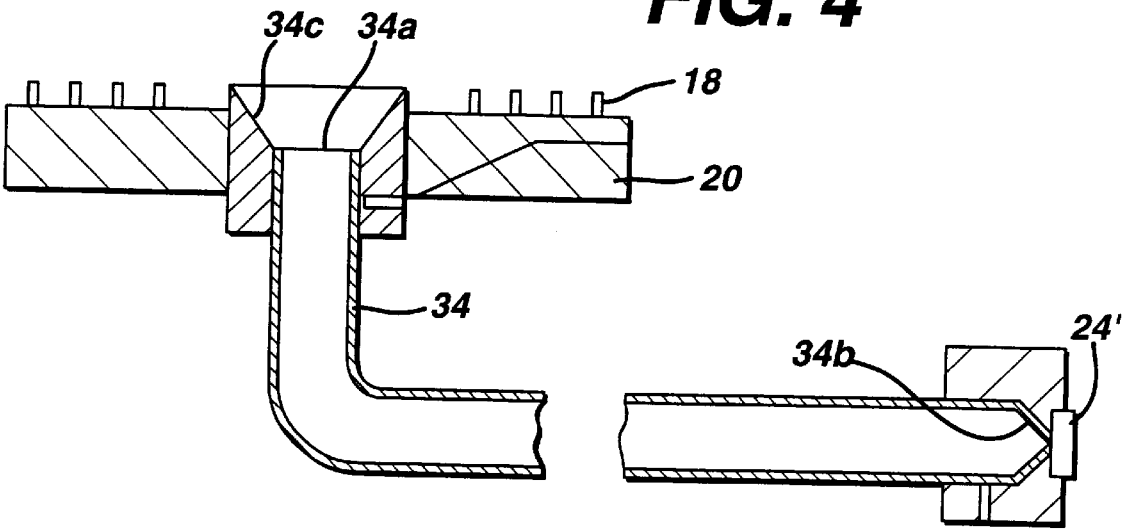
FIG. 4 is a cross-sectional view of a waveguide assembly utilized with the system according to the present invention.
Figure 5:
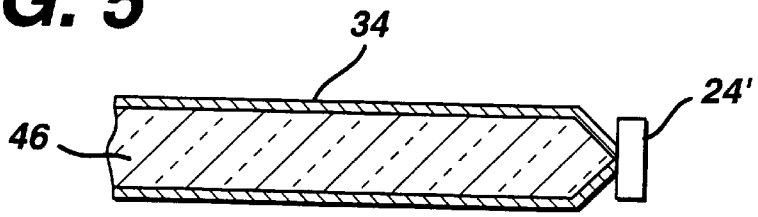
FIG. 5 is a cross-sectional view of the waveguide assembly of FIG. 4 including a solid waveguide according to the present invention.

FIG. 4 is a cross-sectional view of a waveguide assembly utilized with the system according to the present invention in which the waveguide 34 has an inlet end portion 34*a* and an exit end portion 34*b* through which the infrared radiation passes to impinge upon the optical detector 24'. The inlet end portion 34*a* of the waveguide 34 is shaped for optimum energy collection. For example, portion 34*a* includes an optical concentrator facing and communicating with chamber 22 and also communicating with the interior of waveguide 34. Similarly, the exit end portion 34*b* is shaped for optimum energy concentration into the detector. For example, portion 34*b* includes a concave throat facing and communicating with the interior of waveguide 34 and also communicating with detector 24'. The waveguide 34 does not have to be tubular. For example, optionally it is made of a solid material that is optically conducting to the radiation in the selected wavelength range, where, for example, the waveguide is a solid waveguide 46 fabricated from an optically infrared conducting material, such as $Al_2O_3$, as shown in FIG. 5.

The detectors used in the present system include thermal detectors, quantum detectors, or other detectors that are sensitive to infrared radiation. The quantum detectors are detectors with a responsive element that is sensitive to the number or mobility of free charge carriers such as electrons and holes are that are brought about by the incident infrared photons, and are also known as photon detectors. Examples of photon detectors include silicon or germanium photodiode, InGaAs, or PbS. In addition, the optical detector 24' may also comprise a thermal detector including thermopile, a bolometric detector, or other infrared radiation detectors. A thermal detector is a detector whose responsive element is sensitive to temperature brought about by the incident radiation. In an alternative embodiment, a quantum detector is employed in addition to a thermal detector. This combination of detectors permits separation of wavelength sensitivity and increases the specificity and the sensitivity of the overall detector assembly.

Regardless of the number and type of optical detectors 24 or 24' utilized, the detectors 24, 24' are all connected to signal processing circuitry, illustrated generally at 38 in FIG. 2, which, in turn, supplies a signal indicative of the boil state of the contents 16 to a processor 40. The processor 40 automatically controls the temperature of the heating coil 18 according to a desired state, or reduces the temperature of the heating coil 18 when a boil, boil-over, or boil-dry state is detected. Optionally, the processor 40 actuates an alarm indicator 50, such as an audible, visual or data indicator, indicating that a predetermined boil state has been reached.

Figure 6:
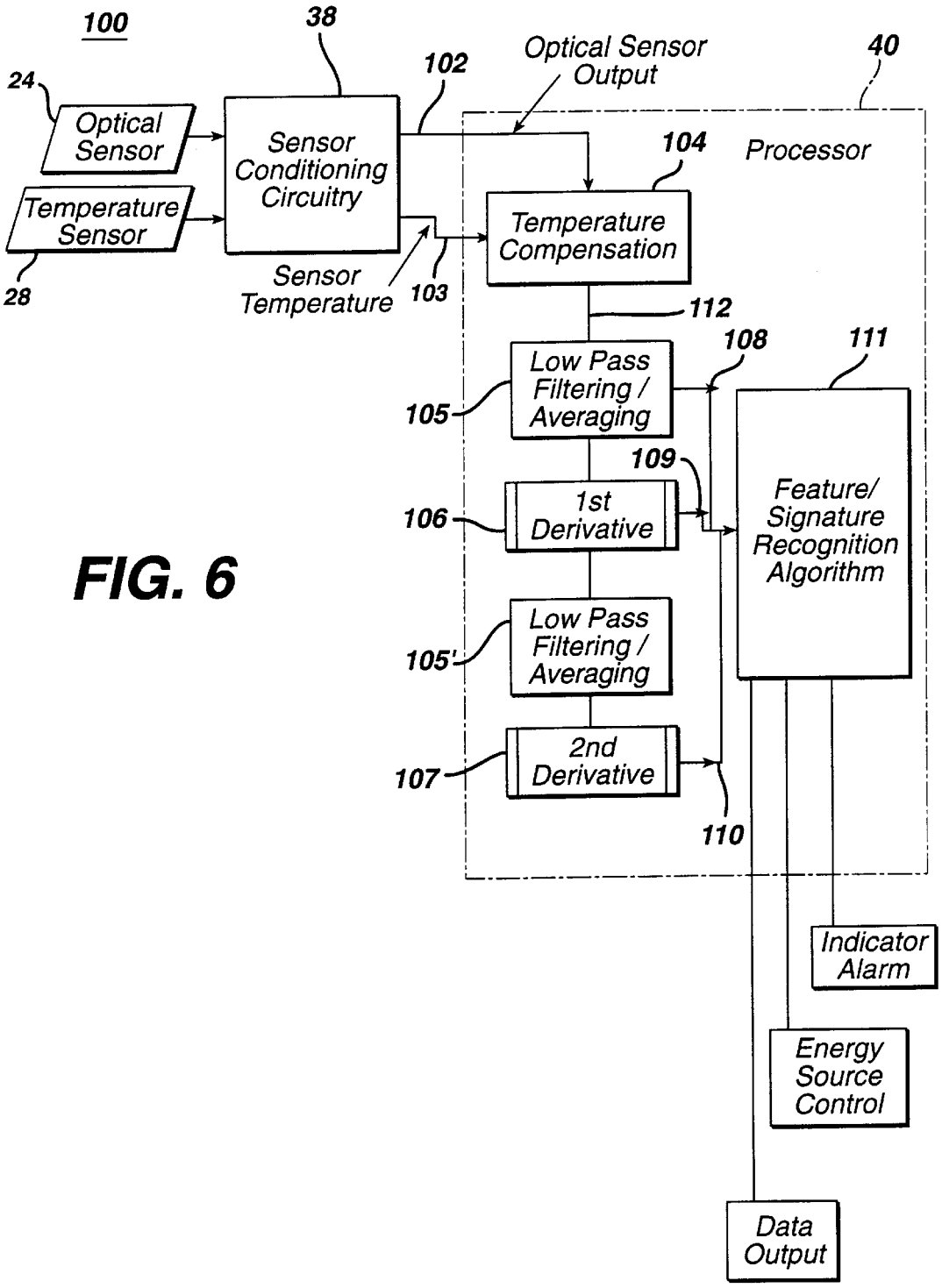
FIG. 6 is a block diagram showing the components of a monitoring system 100 according to the present invention.
Figure 7:
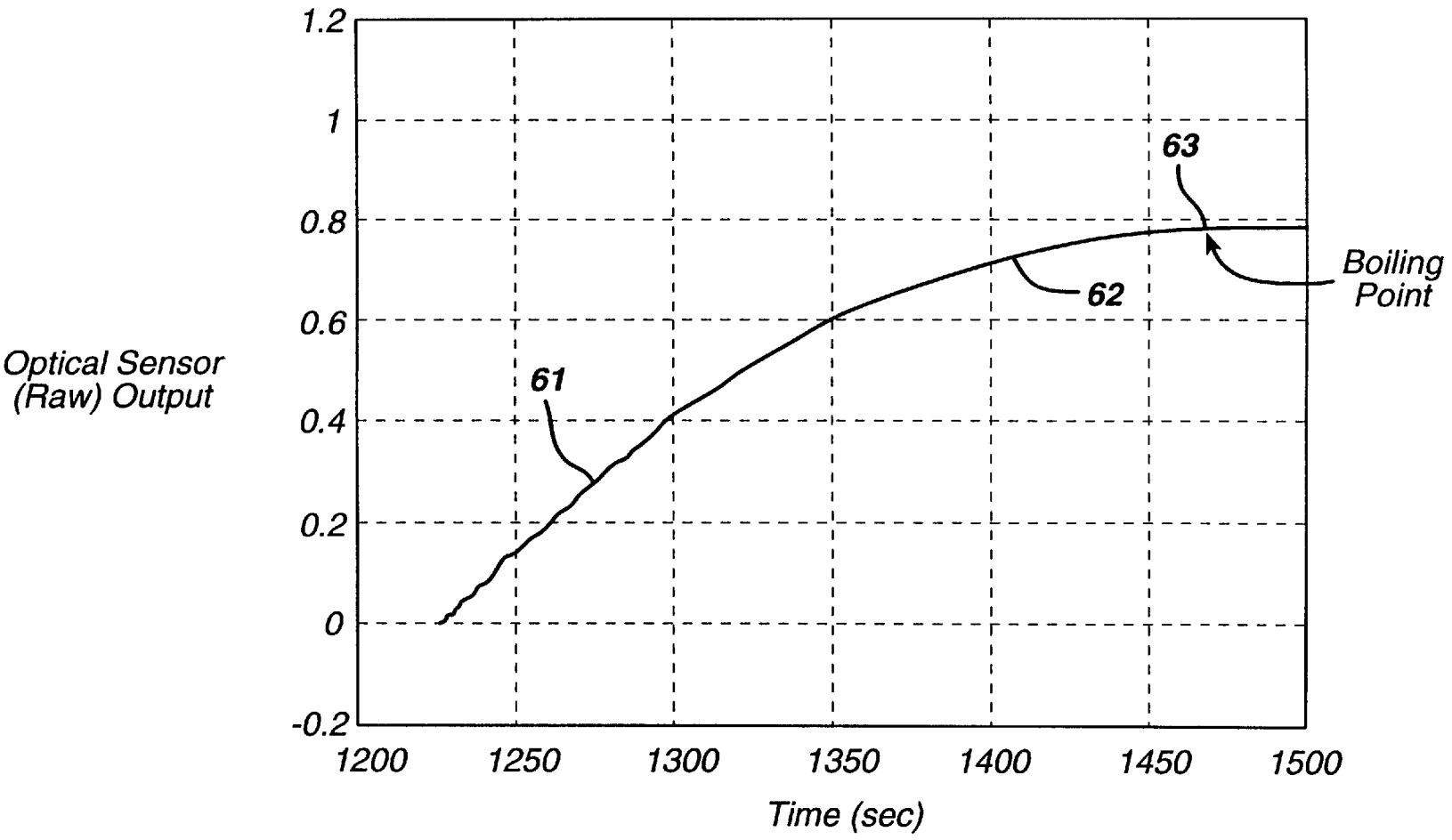
FIG. 7 is a graph illustrating the optical signal and the signature or feature in the optical signal that corresponds to the boiling state.
Figure 11:
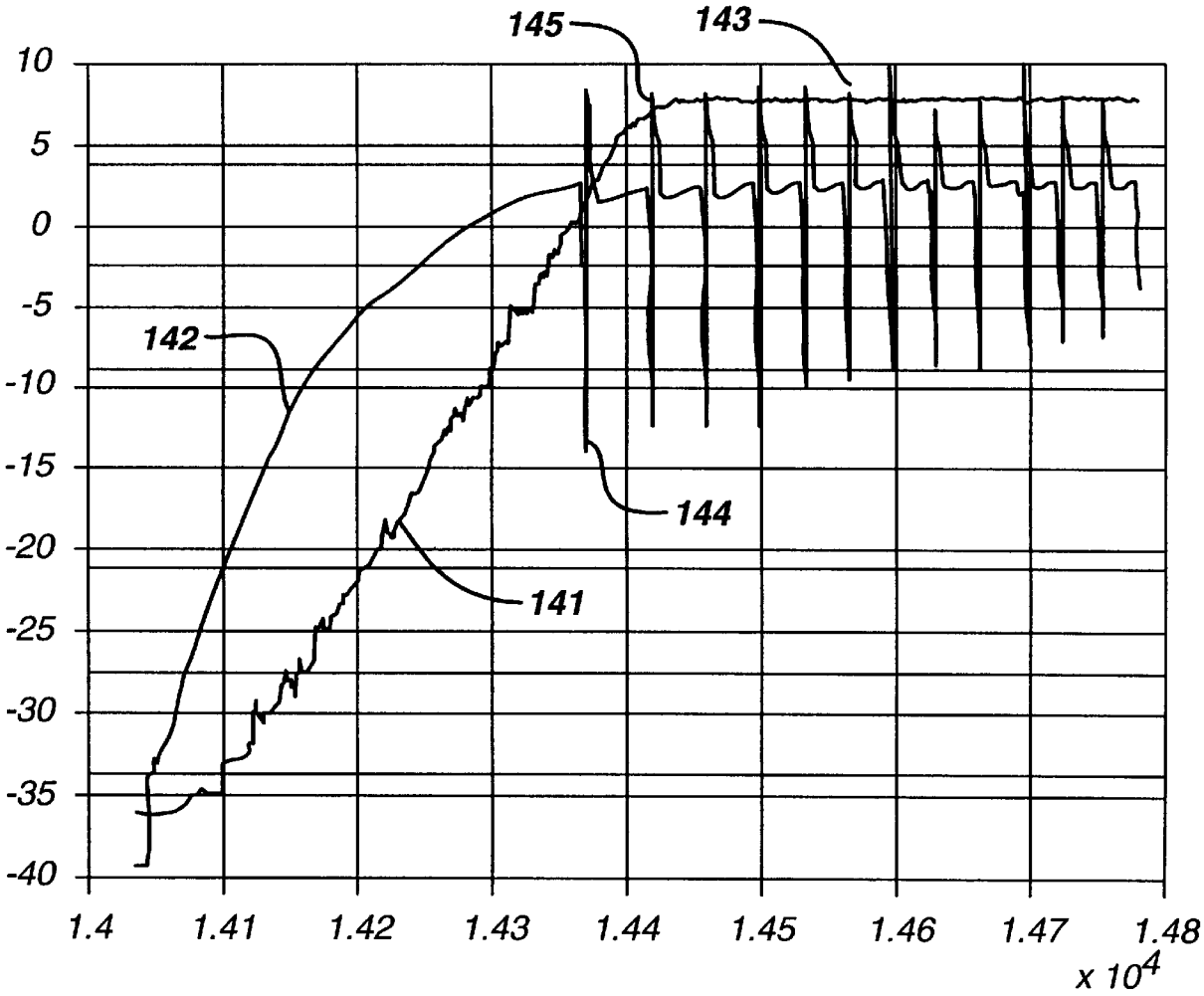
FIG. 11 is a graph illustrating the correlation between the signal from the optical sensor and the water temperature in a utensil on the cooktop.

FIG. 6 is a schematic block diagram showing the components of a detector system 100, including sensors connected to a processor for providing signal input to interconnected calculator functions located within the processor. More particularly, an optical sensor 24, and a temperature sensor 28 are each connected to pass a respective signal to a sensor conditioning circuitry 38. The sensor conditioning circuitry 38 is connected to the processor 40 and the conditioned optical signal calculated by circuitry 38 and graphically illustrated as 61 in FIG. 7 is passed via signal line 102 to the temperature compensation calculator 104, located within processor 40. Ambient temperature sensor 28, which indicates the ambient temperature at the location of the optical sensor 24, is connected to sensor conditioning circuitry 38 and further connected via signal line 103 to the processor 40 for passing an ambient temperature signal to the temperature compensation calculator 104, which includes a software program arranged to calculate a temperature compensated signal. These software programs calculate a correction based on the voltages obtained from the output 103 of the temperature sensor 28 and the filter used on the optical sensor 24. For a broad band filter, for example, the calculation carried out by the processor 40 is:

$$V_{comp}=V_{opt}+C_{rem}T^4{}_C$$

where $V_{comp}$ refers to the output 102 (as shown in FIG. 11) of the optical sensor 24, $T_c$ refers to the output 103 of temperature sensor 28 expressed in degrees Kelvin, and $C_{rem}$ is a constant that depends on the calibration of the sensor and its housing details. The term $V_{comp}$ then refers to the temperature compensated optical sensor output 112, shown in FIG. 6.

The temperature compensated signal is passed from the calculator 104 to a low-pass filtering/averaging calculator 105, and the result calculated by calculator 105 is passed to both a first derivative calculator 106 and via a signal line 108 to a feature/signature recognition algorithm calculator 111, to be described.

The calculated output of the first derivative calculator 106 is passed to both a second low-pass filtering/averaging calculator 105' and via a signal line 109 to the feature/signature recognition algorithm calculator 111.

The calculated output of the second low-pass filtering/averaging calculator 105' is passed to the second derivative calculator 107, which in turn, passes the calculated second derivative of the optical signal via a signal line 110 to the feature/signature recognition algorithm calculator 111. Calculator 111 is connected to a data output 50, an energy source control 52, and an alarm indicator 54 such as an audible, visual or data indicator, indicating that a predetermined boil state has been reached.

FIG. 7 is a graph illustrating the optical sensor signal 61, which is the conditioned optical signal calculated by circuitry 38 and passed via signal line 102 to the temperature compensation calculator 104, located within processor 40. The graph shown in FIG. 7 is a plot of the voltage output of the optical sensor 24 as a function of time in seconds. Event 62 represents the start of the simmer phase, and event 63 represents the boiling point. In one embodiment, Event 62 is identified with the positive but decreasing first derivative reaches a pre-determined range of values, for example, 0.0129 to 0.0075. The starting value is heuristically or empirically determined and belongs to the characteristic features-set of the cooking cycle. The start of the boil phase is identified when the positive but decreasing first derivative approaches zero. This phase is known as a "rolling boil phase", i.e., a phase at which stage the boiling liquid is highly agitated and made turbulent by the increased number of gas bubbles formed and escaping out of the liquid, and the liquid bulk is saturated. During a rolling boil phase, the temperature of the liquid does not increase, regardless of the amount of additional heat applied to the boiling liquid. Alternatively, a very small threshold value is used instead of zero to detect the boil phase. This threshold value is also heuristically or empirically determined. This basic approach is also used in the case that a sensor other than optical is used to determine the cooktop temperature since a similar characteristic feature is observed.

In the case of attaining the boil phases after the glass temperature reaches a pre-selected protective value, the features related to the boil phases will be in the signal indicative of the power supplied to the energy source rather than the sensor output. In this case, the sensor output is used to attain the protective or constant temperature state. In the case of the boil phase it is determined that the cooktop temperature no longer increases with increased power. Alternatively the amount of power required to maintain a constant cooktop temperature is reduced, and that reduction is monitored to detect the onset of the boil phase. In one embodiment this feature is used to provide energy savings through reduction of the power applied once boiling is achieved.

Figure 8:
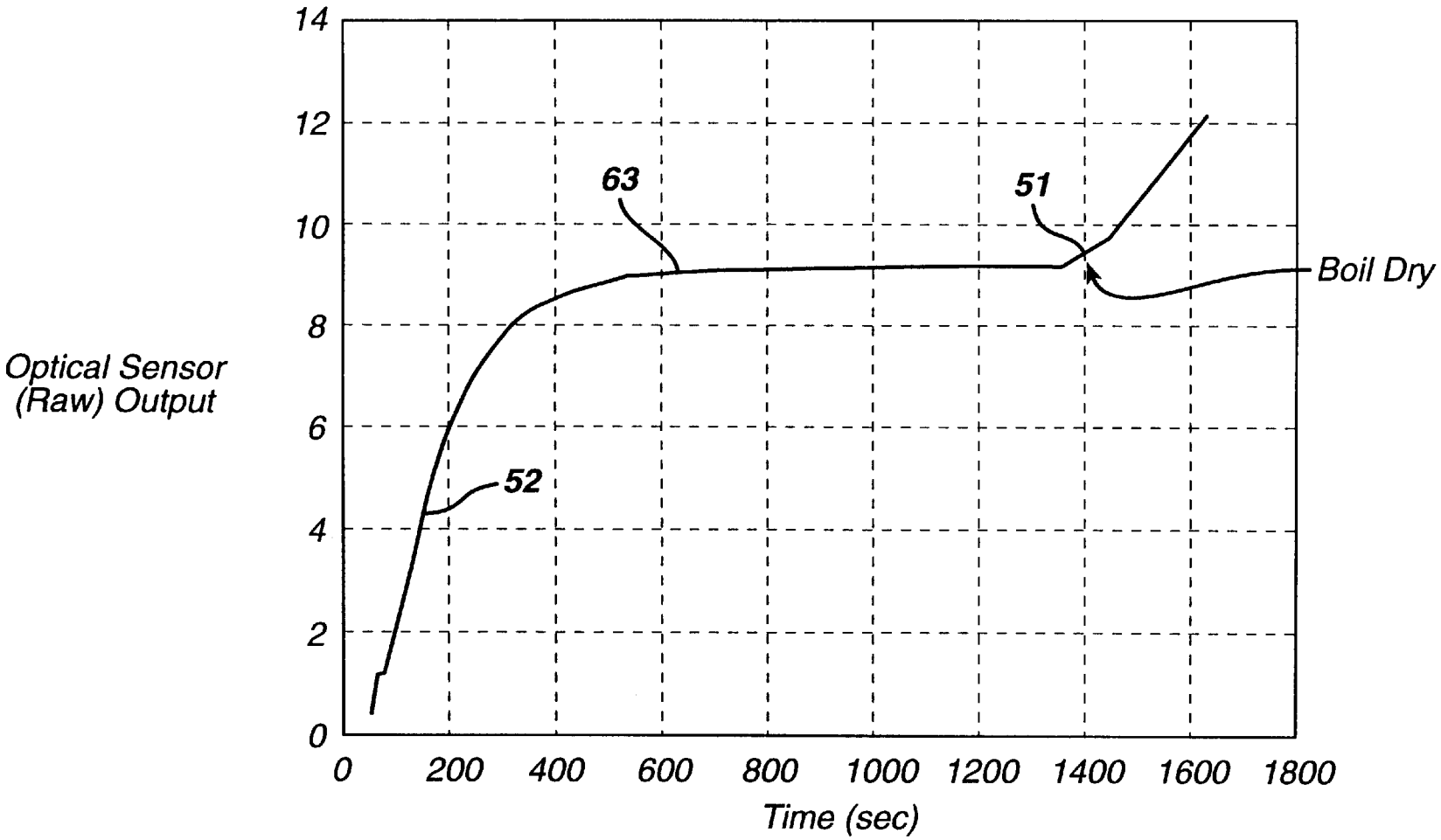
FIG. 8 is a graph illustrating the optical signal and the signature or feature in the optical signal that corresponds to the boil-dry state.

FIG. 8 is a graph illustrating the same optical sensor signal 52, as transition from the boiling point 63 to a boil-dry state 51 occurs. A boil-dry state is the condition when the liquid contents of the heated utensil evaporates during the boil phase. This boil-dry condition generates a unique optical characteristic waveform 51, as illustrated in FIG. 8, where, in one example, filtered and amplified optical signal 52 is plotted over a time interval of about 1800 seconds. The boil-dry condition becomes evident in the interval between about 1400 seconds and about 1600 seconds. The boil-dry condition, typically, occurs after rolling boil phase 63 has been achieved, as shown in FIG. 7. As such, the boil-dry condition is evidenced by a particular and sudden increase in the optical signal 52. In addition, a sudden change and increase in the derivative of signal 52 is also indicative of the boil-dry condition. By way of example, and not limitation, the rate of change illustrative of a boil-dry condition 51 may be identified as a 20% magnitude increase in filtered optical signal 52 over a 200 second time interval, after rolling boil phase 63 is achieved. In the case that a protective or constant temperature state is being maintained, the boil dry state will be observed as a sudden decrease in the amount of power needed to maintain the constant temperature.

There are interferences, such as pan removal and pan placement, which cause signal features which can be mistaken for boil-dry. For this reason a pre-determined range of values is used to distinguish boil dry in the presence of these features. An alternative embodiment calculates this range of values dynamically based on prior behavior. Alternatively, an additional input signal as to pan presence simplifies this calculation.

The boil-over condition is the condition in which the liquid contents of the utensil begins to boil-over the side of the utensil on the cooktop. The boil-over condition generates a characteristic change in the optical signal, typically, after rolling boil state 63 has been achieved. This change in the signal 52 depends on the embodiment. For the case in which the wavelength range is selected in a band that the glass is at least partially transparent to, the reflected flux 74, shown in FIG. 1, shows a sudden change caused by the scattering and absorption of the radiation by the boiled over fluid and the bubbles. In the embodiment where the optical detector is sensitive, the wavelength band where the glass ceramic is substantially opaque, the change in the heat transfer 73, as well as the change in the cooktop temperature, will create a disturbance in the optical signal 52 in the form of sudden changes which are substantially larger than any noise related changes in the signal.

Figure 9:
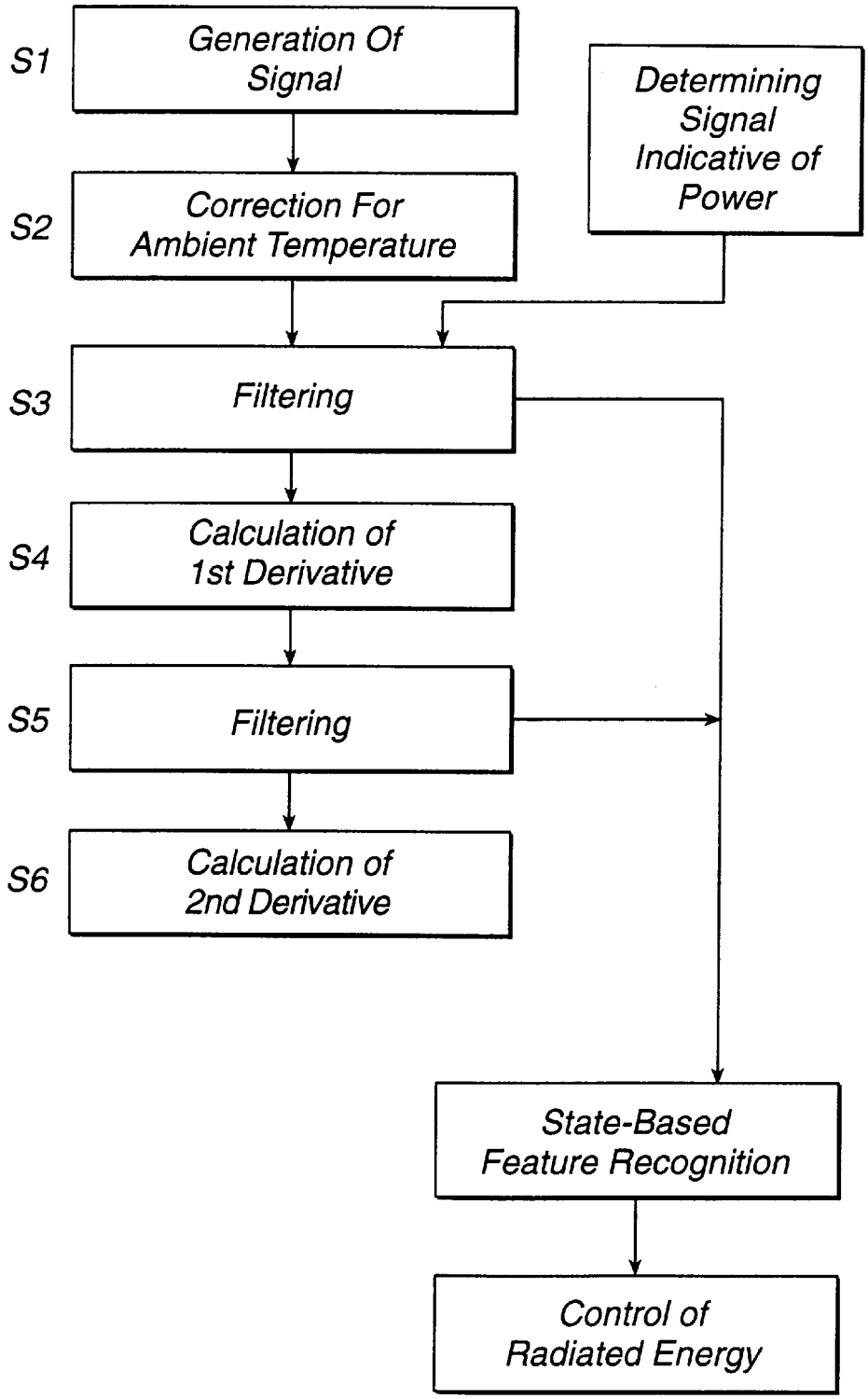
FIG. 9 is a flow chart illustrating an exemplary method of the present invention for detecting boil states in the monitoring system according to the present invention.

FIG. 9 is a flow chart illustrating an exemplary method of the present invention for detecting boil states in the monitoring system more generally than the monitoring system 100 shown in FIG. 6. The method illustrated in FIG. 9 begins with step S1, which includes the generation and conditioning of an optical signal and a separate generation of an ambient temperature signal. In an alternative embodiment, the temperature is measured by means of a non-non-optical sensor and appropriate signal conditioning applied. In step S2, the conditioned optical signal is corrected for ambient temperature variations at the optical sensor 24 location. In an alternative embodiment, an analog temperature compensation is substituted for the digital temperature compensation described in step S2. The input to step S3 consists of the output of step S2 and, optionally, a signal representative of the power or energy supplied to the energy source 12. This signal indicative of power is used as before to detect the phases of interest during a constant temperature state or to adapt the algorithm to various applied power levels as set by the user. Also optionally other signal variants such as pan presence signal is used as input to step S3. In step S3, the input signals are subjected to a filtering calculation such as low-pass filtering or averaging that is used repeatedly, or alternatively recursively, to simplify the determination of the signature and the boil related features of the signal from the detector, such as the plateau, or the rate of increase in rise of the signal. The specific implementation depends on the features being sought. The low-pass filter calculation substantially removes the noise and enables a robust calculation of the first derivative in step S4. In one exemplary embodiment, the low-pass filter calculation is implemented in such a way that each signal value is replaced by the statistical mean of "n" prior signal values. The number of points, "n," that can be used is a function of the tolerable response delay and should be chosen such that the feature recognition algorithm determines the boil state in near real time.

In step S4, the first derivative of the filtered signal is calculated. The incremental derivative signal is calculated at each time-point by determining the difference between the current and previous value of the low-pass filter signal divided by the time step between the two readings. It is to be noted that this calculation produces a smoothed and slightly delayed first derivative of the optical signal or the signal representative of the power.

At this point, the information necessary for the feature and signature recognition algorithm may be complete, depending on the specific implementation and the features being analyzed. If the required information is complete, the boil phase detection is carried out by a series of feature recognition steps using the data generated by steps S1–S4, as carried out by the algorithm 111 described in connection with FIG. 10. Otherwise, control proceeds to step S5, for further filtering and the calculation of higher order derivatives.

If the required information is not complete, the first derivative obtained in step S4 is then passed to step S5, in which a second low-pass filtering calculation of the derivative is computed, thereby removing noise and enabling a robust calculation of a second derivative of the signals in step S6. This second low-pass filtering is implemented in a substantially similar way to the low-pass filtering calculation step S3.

At step S6, the second order derivative of the calculated result is computed. However, it is possible, depending on the features of the signal sought, that no signal characteristics beyond the first derivative are required. The derivative values calculated in steps S4 and S6 as well as the value calculated at the first low-pass filtering/averaging step S3 are passed to the feature/signature recognition algorithm 111, as described in connection with FIG. 10.

Figure 10:
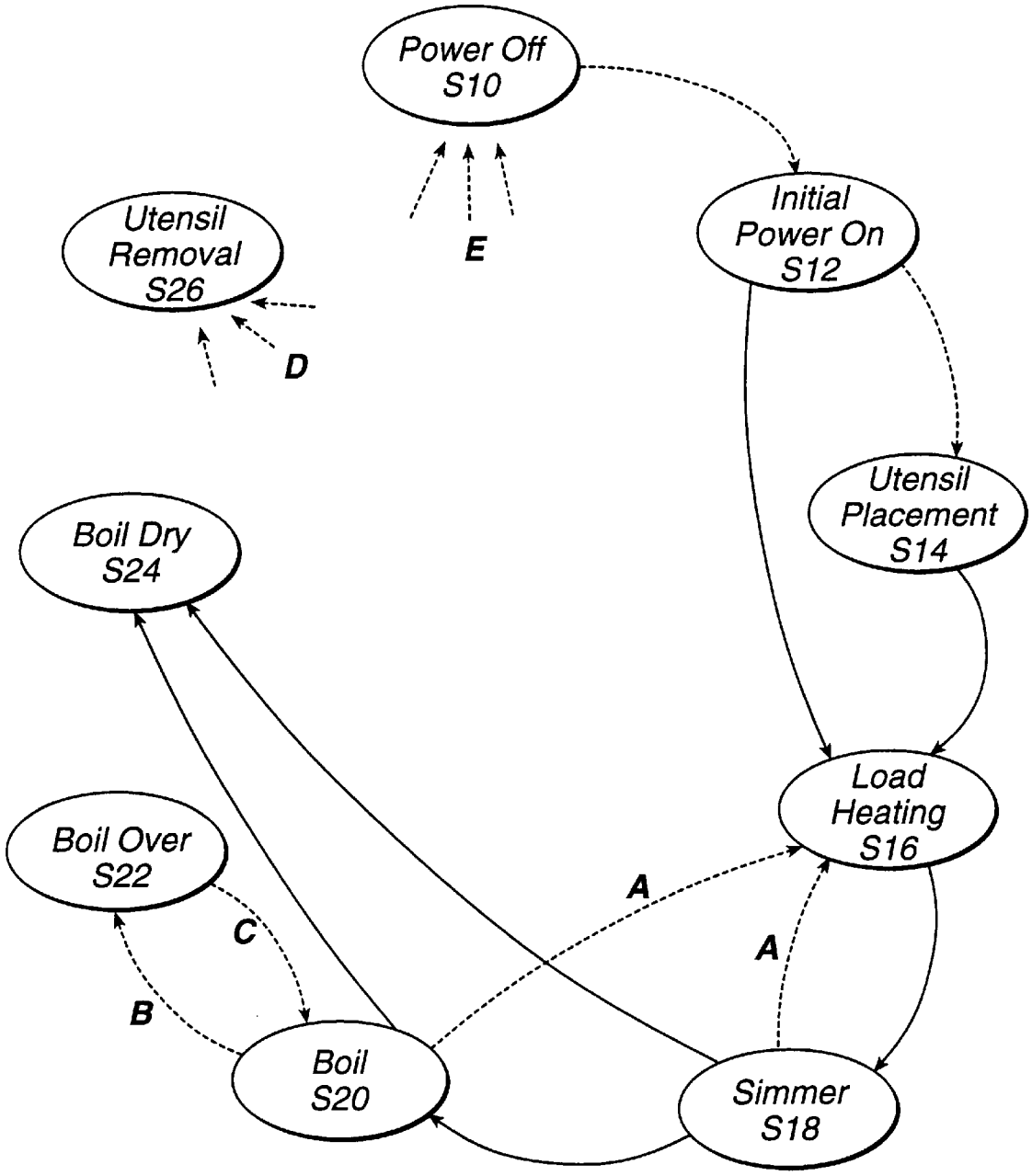
FIG. 10 is a state diagram of the state-based feature recognition algorithm 111 used to determine boil states according to the invention.

FIG. 10 is an exemplary state diagram of the state-based feature recognition algorithm 111, such as in FIG. 9, used to determine boil states according to the invention. Algorithm 111 includes illustratively important states that a utensil and associated contents undergo after power is applied to the heat source of a cooktop. For ease of description, user interactions and power/energy adjustments are shown as interactions (A)–(D), to be described. Solid lines indicate no user interaction and dashed lines indicate user interactions resulting in additional state transitions.

The specific inputs and thresholds which determine state transitions are dependent on specific ranges of absolute temperature, because the cooktop control mechanism changes in order to protect the glass from extreme temperatures. For instance, for a specified maximum temperature, a thermal limiting function will cause the temperature to remain substantially constant while the power applied to maintain this temperature will vary in accordance with the states specified. In this case the transitions between states will depend on the power signal and it's characteristics in much the same way as described for the temperature signal in FIG. 9. FIG. 10 shows the details of Algorithm 111 where the inputs, not shown in FIG. 10, but shown in FIG. 9, include one or more of the temperature measurement, temperature measurement derivatives, a signal representative of the power, and derivatives of the power signal. If other information is available, for example, a pan presence indicator signal, this input may be used to simplify Algorithm 111.

In FIG. 10, the cooktop power is off at state S10. At state S12, the cooktop power has just been turned on and is in an initial power-on transient state. State 12 is reached by user interaction (dashed arrow), as a result of the user manually establishing a power setting for a selected burner of the cooktop. State 14, utensil placement on the cooktop, is reached via user interaction, as illustrated by a dashed arrow. In some case the utensil is already present when the power is turned on, so that state S14 is never entered. State S16, Heat Loading, occurs, by at least the cooktop itself, even if no utensil has been placed on the cooktop by the user. For the case of water heating, State S18 (Simmer) is reached without user interaction (solid arrow), as are state S20 (Boil), and state S24 (Boil-dry). State S22 (Boil-over) may occur depending on food contents in the water, and may be the result of user interaction adding that food.

FIG. 10 also indicates by dashed arrow, a return from state S20 (Boil) to state S16 (Heat Loading) as a result of any of three interactions (A–C). Interaction (A) includes first, power adjustment, which is either the result of manual adjustment by the user or automated power adjustment, either method resulting in maintaining a selected boil state, including simmer and rolling boil. The second of three interactions (A) is the addition of food/water by the user, and the third interaction is the user stirring the contents of the utensil. FIG. 10 also shows the same three interactions (A) are applicable to the Simmer step S18, which also would result in a state change back (dashed arrow) to the Load Heating state S16.

Similarly, interaction (B), the addition of food, applies between state S20 (Boil) and state S22 (Boil-over) (dashed arrow). Interaction (C), illustrated by a dashed arrow from the Boil-over state S22 back to the Boil state S20, includes a (manual or automatic) power adjustment, or a boil-over of sufficient water to result in cessation of sufficient water to boil over. Interaction (D) is illustrated by dashed arrows from any heating state to the Pan Removal state S26. As stated previously, the transition to this state and state S14, Utensil Placement, must be differentiated from state S24 through careful selection of transition values or additional signal inputs. Interaction (E), also illustrated by dashed arrows, indicates user or automatic control interaction from any state in general, directed toward the Power Off state S10. In this embodiment the current estimated state of the system determines how the signal inputs are calculated and interpreted.

In one alternative embodiment the state of the system as shown in FIG. 10 is identified probabilistically, such that a range of possible states are identified, each with an associated probability of being the most accurate. This approach is used to accommodate ambiguous signal input or to allow variability in each individual users definition of boil state, for instance the point at which they consider simmering liquid to reach a boil.

A known method of limiting the operation of the type of heat source used with ovens and ranges is long cycle power cycling, in which the power is cycled on and off on the order of several seconds. A basic arrangement of this method includes a electromechanical thermalimiter device having a fixed thermal limiter cycle, that turns on/off according to a fixed timing cycle and whose period is substantially independent of actual temperature. When used with a glass ceramic cooktop, an undesirable accumulation of heat in the cooktop can still occur, and there is limited ability to protect the cooktop during the boil-dry mode.

A tighter control is possible with another known arrangement of higher frequency power cycling that uses a close approximation of actual temperature to determine when to cycle ON and OFF. This type of control also is of the on/off type, and is more accurate than the traditional method of temperature control. In this embodiment the frequency or the duty of the cycling will change with the state of the system, for instance during the Boil Dry state, S24 in FIG. 10, the time in the ON state becomes shorter before the power is once again turned OFF. Therefore the most informative signal inputs for the state transitions FIG. 10 will comprise the sequence of actual power ON and power OFF cycle times, rather than temperature values.

Another option for obtaining accurate temperature control of a cooktop is through the control of level of power applied to the cooktop, rather than through long period on/off power cycling. By taking advantage of the 60 Hz current commonly applied to the cooktop, a known procedure is employed that includes "cycle stealing", in which cycles of current are turned on/off at a very high rate, almost imperceptible to the human eye. Such fluctuation is so rapid, that the glass ceramic cooktop temperature does not respond significantly to each individual cycle. In this high frequency control arrangement, power levels are controlled at a 100%, 90%, etc. levels. In this embodiment the power signal becomes the most informative with respect to the state transitions in FIG. 10, as the power level automatically adjusts to keep the temperature controlled. As one example, the power level would reduce during a Boil Dry state, while the temperature would remain constant.

FIG. 11 is a graph illustrating the correlation between the signal from the optical sensor 28 and the water temperature in a utensil positioned on the cooktop, where the low frequency power cycling method is used to obtain temperature control of the glass ceramic. The waveform 141 represents the water-based food temperature in the cooking utensil on the cooktop, where the X-axis is time in seconds, starting from some arbitrary origin based on experimental details, and the Y-axis is in volts, but also corresponds to different values of the gain G in amplifier device 224 of FIG. 3. The optical signal 142 is generated by optical sensor 24 and conditioning circuitry 38. The waveform 141 is produced by locating the sensor position 24 below the burner and using a particular wavelength band that includes the 5$\mu$–15$\mu$range. Instead of using a more higher frequency power control, the data represents the case of low frequency power cycling, described above, to obtain temperature control of the glass ceramic. This power cycling is apparent in the optical signal 142 as the sudden changes 144 in the signal. The boiling point corresponds to the plateau 145. The corresponding feature 144 appears in the optical signal 142.

Figure 12:
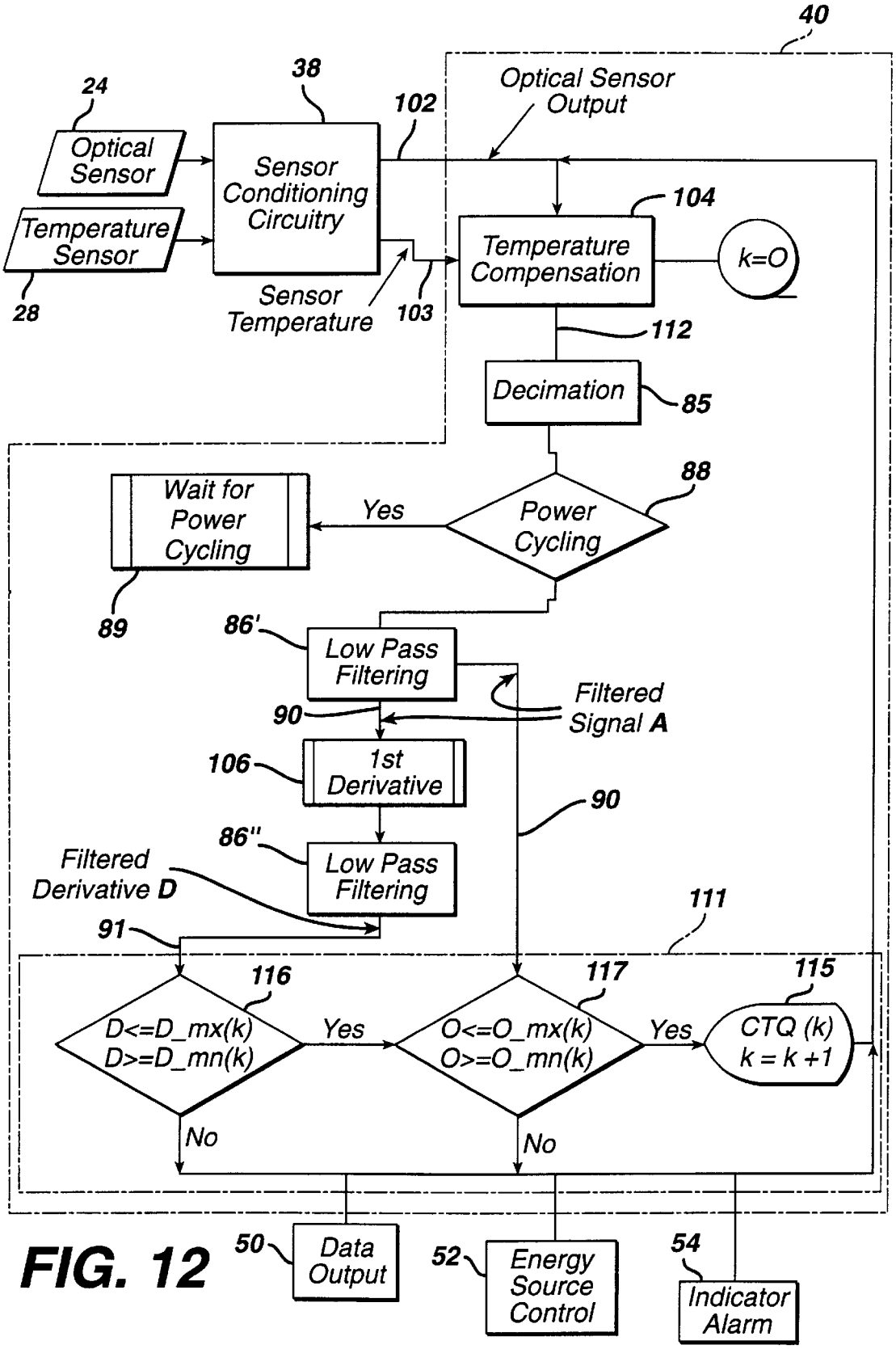
FIG. 12 shows an exemplary method for detecting boil states for the case of low frequency power cycling in a sensor system 80 according to the present invention.

FIG. 12 shows exemplary system 200 for detecting boil states that includes a decision sequence that is applicable to various forms of power cycling. System 200 differs from system 100, illustrated in FIG. 6, by including a state value calculator 115 that is incremented after successful completion of the computation of algorithm 111, where the state k is a parameter represented in Table 1. System 200 also includes a decimation calculator 85, used for lowering sampling rate in a know fashion, and connected between temperature compensation element 104 and low pass filtering element 86. While both systems 100 and 200 include algorithm 111, which is understood to include all decision branches described in connection with FIG. 10, system 200 is illustrated as including an example calculation within algorithm 111 for one boil state.

In system 200, a filtered signal O is output by low pass filter 86' to both the first derivative calculator 106 and to algorithm 111, and a filtered derivative D is also output by the low pass filter 86" to algorithm 111. A power cycling detection element 88 determines whether the algorithm should be initiated. By way of example, values of the amplitude and derivatives are shown in Table 1 for each state value k. These specific values depend on the design configuration and desired performance levels.

TABLE 1

| Parameter P (k) | Below | Simmer | Boil |
|---|---|---|---|
| K | 1 | 2 | 3 |
| O_mx | 7.3919 | 6.9847 | ∞ |
| O_mn | 4.5691 | 3.5186 | 3.0000 |
| D_mx | 0.0299 | 0.0129 | 0.0076 |
| D_mn | 0.0030 | −∞ | −∞ |

In this exemplary embodiment these values are heuristically based on correlation with food temperature and the desired phases through experimentation of other techniques based on user preference. In an alternative embodiment these values are determined on a dynamic basis based on information contained in prior signal values. For each of the three states P(k), the filtered, maximum derivative D_mx (k), and filtered, minimum D_mn(k) are passed to calculator 116 of algorithm 111, and when D_mx(k) is found to be greater than, or equal to, the derivative D, and D_mn(k) is found to be less than, or equal to, the derivative D, the comparison of calculator 117 is performed. Calculator 117 performs a comparison in which, when the filtered, maximum temperature compensated signal O_mx(k) is greater than, or equal to the unprocessed optical signal O, and when O_mn(k) is less than, or equal to the unprocessed optical signal O, the state value P(k) is updated at calculator 118. In this way, all three states P(k) shown in Table 1 are considered. In this particular embodiment the state transitions are sequential and optionally are implemented with an increment function. The state model illustrated in FIG. 10 is more complex and requires a set of state dependent transitions.

It will be apparent to those skilled in the art that, while the invention has been illustrated and described herein in accordance with the patent statutes, modifications and changes may be made in the disclosed embodiments without departing from the true spirit and scope of the invention. It is, therefore, to be understood that the appended claims are intended to cover all such modifications and changes as fall within the true spirit of the invention.

What is claimed is:

1. A system for detecting the boil state of contents of a cooking utensil located on a cooking surface of a cooktop, comprising:

at least one controllable energy source located relative to the cooktop so as to heat the cooktop and the cooking utensil;

at least one power signal indicative of the level of power supplied to the at least one controllable energy source, where the power indicative signal includes one of power level, power-on and power-off cycle times, or a function of power-on and power-off cycle times;

at least one parameter sensor arranged to sense a parameter related to at least one of the cooktop and the cooking utensil, said at least one sensor being arranged to issue a parameter signal responsive to the sensed parameter; and a signal processing device connected to the at least one parameter sensor for receiving the issued parameter sensor signal and arranged to receive the at least one power indicative signal, said signal processing device being arranged to process the received parameter sensor signal and the power indicative signal to detect a known signal pattern indicating a boil state of the contents of the cooking utensil.

2. The system of claim 1 wherein the sensed parameter is radiated energy.

3. The system of claim 1 wherein the at least one sensor detects radiated energy emanating from a portion of the cooktop cooking surface in contact with the cooking utensil.

4. The system of claim 1 wherein the at least one sensor detects radiated energy emanating from the cooking utensil and passing through the cooktop.

5. The system of claim 1 wherein the at least one sensor detects radiation emanating from a lower surface of the cooktop below the cooking utensil.

6. The system of claim 5 wherein the detected radiation includes infrared radiation in selected wavelength ranges including 5–8 microns.

7. The system of claim 1 further comprising at least one control device for controlling energy generated by the at least one energy source and connected to the signal processing device.

8. The system of claim 1 wherein the sensed parameter is temperature.

9. The system of claim 8 wherein the at least one sensor detects temperature emanating from a portion of the cooktop cooking surface in contact with the cooking utensil.

10. The system of claim 8 further comprising a plurality of controllable heat sources and associated, respective sensors located below the lower surface of the cooktop and respective power indicative signals.

11. The system of claim 8 further comprising at least one control device for controlling energy generated by the at least one energy source (12) and connected to the signal processing device.

12. The system of claim 8 wherein said at least one sensor signal is temperature compensated so that the signal pattern excludes ambient temperatures.

13. The system of claim 8 wherein said at least one sensor comprises any of a thermal sensor, a resistance temperature detector, a thermocouple, and an optical sensor.

14. The system of claim 8 wherein the detected boil state is a simmering phase and the signal processing device detects a simmer signal feature indicating the start of the simmering phase.

15. The system of claim 14 wherein the simmer signal feature is a positive but decreasing first derivative of the sensor signal reaching a simmer range of values selected from predetermined and dynamically calculated values.

16. The system of claim 15 wherein the simmer signal feature is a negative first derivative of the signal indicative of power, the negative first derivative reaching a predetermined and dynamically calculated range of values.

17. The system of claim 8 wherein the detected boil state is a boiling phase and the signal processing device detects a boiling signal feature indicating the start of the boiling phase.

18. The system of claim 17 wherein the boiling signal feature is a positive but decreasing first derivative of the sensor signal reaching one of a predetermined small threshold value, a dynamically determined small threshold value, or zero value.

19. The system of claim 18 wherein the boiling signal feature is a negative first derivative of the signal indicative of power, the first derivative reaching one of a predetermined small threshold value, a dynamically determined small threshold value, or zero value.

20. The system of claim 8 wherein the detected boil state is a boil-dry phase and the signal processing device detects a boil-dry signal feature indicating the start of the boil-dry phase.

21. The system of claim 20 wherein the boil-dry signal feature is one of a sudden increase in the sensor signal or a sudden change and increase in a first derivative of the sensor signal within a range of values.

22. The system of claim 20 wherein the boil-dry signal feature is one of a sudden decrease in the signal indicative of power, a sudden change and decrease in a first derivative of the signal indicative of power within a predetermined range of values, or a sudden change and decrease in a first derivative of the signal indicative of power within a range of values calculated dynamically based on prior signal values.

23. The system of claim 8 wherein the detected boil state is a boil-over phase and the signal processing device detects a boil-over signal feature indicating the start of the boil-over phase.

24. The system of claim 23 wherein the boil-over signal feature is a sudden change in the sensor signal substantially matching at least one heuristically pre-determined boil-over signal feature associated with the boil-over phase.

25. The system of claim 8 further comprising an indicator connected to the signal processing device, the indicator being arranged to generate a visual, audible, or data signal responsive to said signal processing device.

26. The system of claim 8 wherein the signal processing device further being arranged to calculate a set of probable boil states, each probable state having a respective probability of being a most accurate representation of an actual current boil state.

27. A method for monitoring the boil state of contents of a cooking utensil on an energized cooking surface and controlling the energy applied to the cooking surface comprising the steps of:

generating at least one sensor signal having a signal value indicative of temperature related to at least one of the cooktop and the cooking utensil;

generating at least one power signal indicative of power; and calculating a series of feature recognition steps using said at least one sensor signal and said at least one power signal indicative of power to determine from said calculation at least one boil state.

28. The method of claim 27 further comprising the step of controlling the energized cooking surface based on said determination.

29. The method of claim 27 wherein the step of calculating a series of feature recognition steps includes the steps of:

correcting the sensor signal for ambient temperature to achieve a corrected sensor signal value;

deriving filtered values representative of the corrected sensor signal value;

calculating characteristics of respective filtered values;

calculating derivative values of at least one of the sensor signal value and the corrected sensor signal; and calculating a series of feature recognition steps from at least one of the sensor signal value, corrected sensor signal value, filtered values and derivative values.

30. The method of claim 29 wherein the characteristics include one of a first order derivative of the filtered value, a higher order derivative of the filtered value, or a combination of a first and a higher order derivative of the filtered value.

31. A method for monitoring the boil state of contents of a cooking utensil and controlling energy applied to a cooking surface comprising the steps of:

calculating a series of feature recognition steps including comparing a plurality of derivative values and a plurality of amplitudes of filtered values;

evaluating said comparison against one of pre-determined values and dynamically calculated values to determine a boil state; and controlling the energized cooking surface based on said determination of the boil state.

32. The method of claim 31 further comprising the step of determining a set of probable boil states, each probable state having a respective probability of being a most accurate representation of an actual current boil state.

* * * * *